US005961004A

United States Patent [19]

DeMars

[11] Patent Number: 5,961,004

[45] Date of Patent: Oct. 5, 1999

[54] BEVERAGE CONTAINER FOR HOT LIQUIDS WITH SEPARATE CONSUMING COOLING RESERVOIR

[76] Inventor: Robert A. DeMars, 23221 Ladrillo Ave., Woodland Hills, Calif. 91367

[21] Appl. No.: 09/036,861

[22] Filed: Mar. 9, 1998

[51] Int. Cl.[6] ..... B67D 5/06; B65D 37/00; A47G 19/22

[52] U.S. Cl. ..... 222/205; 222/209; 222/210; 222/211; 220/710.5; 220/715

[58] Field of Search ..... 222/205, 209, 222/210, 211, 401, 464.1, 385; 220/714, 715, 710.5

[56] References Cited

U.S. PATENT DOCUMENTS

| | | | |
|---|---|---|---|
| 762,300 | 6/1904 | Fulton . | |
| 985,598 | 2/1911 | Jeanson . | |
| 1,181,783 | 5/1916 | Lyons . | |
| 1,328,866 | 1/1920 | Yeatter . | |
| 1,599,967 | 9/1926 | Johnson . | |
| 2,774,517 | 12/1956 | Teegardin et al. | 222/205 |
| 3,105,619 | 10/1963 | Rohrmuller | 222/209 |
| 3,113,698 | 12/1963 | Abplanalp | 222/1 |
| 3,127,068 | 3/1964 | Sutter | 222/209 |
| 3,263,871 | 8/1966 | Thompson | 222/205 |
| 3,300,102 | 1/1967 | Budzich | 222/386.5 |
| 3,739,955 | 6/1973 | Gores | 222/385 |
| 3,877,614 | 4/1975 | Murphy | 222/209 |
| 4,146,154 | 3/1979 | Mastman | 222/109 |
| 4,274,556 | 6/1981 | Thiessen | 222/135 |
| 4,294,384 | 10/1981 | Howell | 224/42.42 |
| 4,310,104 | 1/1982 | Takatsuki | 222/131 |
| 4,359,174 | 11/1982 | Ikunosuke et al. | 222/131 |
| 4,362,256 | 12/1982 | Polasek | 222/383 |
| 4,550,864 | 11/1985 | Tarozzi et al. | 222/209 |
| 4,757,922 | 7/1988 | Landecker | 222/205 |
| 4,763,818 | 8/1988 | Stefano et al. | 222/209 |
| 4,966,300 | 10/1990 | Coonradt | 220/90.2 |
| 5,312,019 | 5/1994 | Tsao | 222/105 |
| 5,405,030 | 4/1995 | Frazier | 215/6 |

*Primary Examiner*—Andres Kashnikow
*Assistant Examiner*—Keats Quinalty
*Attorney, Agent, or Firm*—Jack C. Munro

[57] ABSTRACT

A beverage container for hot liquids which has a vessel with a completely enclosed, thermally insulated, internal chamber within which is to be placed a quantity of consumable hot liquid. A cap is removably mounted on the vessel which is to completely close the internal chamber and, by removing of the cap, permit an additional quantity of hot liquid to be supplied into the internal chamber. A dispensing passage, usually in the form of a tube, extends from the internal chamber to the cap with there being a valve mounted in conjunction with the dispensing passage with this valve being mounted within the cap. Air pressure is to be supplied into the internal chamber which is to cause a small portion of the hot liquid to be conducted through the passage, past the valve, and into a reservoir mounted in conjunction with the cap. The reservoir is open to the ambient permitting consuming of the hot liquid from the reservoir by a human. The pumping of the air into the internal chamber can be accomplished by a bellows assembly mounted in conjunction with the vessel or by a hand operated piston and cylinder arrangement.

7 Claims, 4 Drawing Sheets

BEVERAGE CONTAINER FOR HOT LIQUIDS WITH SEPARATE CONSUMING COOLING RESERVOIR

BACKGROUND OF THE INVENTION

1) Field of the Invention

The field of this invention relates to a liquid dispenser and more particularly to a liquid dispenser mounted in conjunction with an individual hot liquid beverage container.

2) Description of the Prior Art

An exceedingly common activity on the part of humans is to consume hot liquids such as coffee and tea. Special coffee mugs are designed to be used while individuals are engaged in activities such as operating automobiles. Special mugs are designed in order to keep the coffee or tea as hot as possible for as long as the coffee or tea is being consumed. Some individuals consume the beverage within just a few minutes while others actually take an hour or more.

One of the disadvantages of prior art type of hot liquid beverage containers is that when the hot liquid is being consumed over a longer period of time, it does have a tendency for the hot liquid to cool to a temperature very near room temperature which for most individuals is not the preferred temperature in which the hot liquid is to be consumed. The reason for this is that the hot liquid is exposed to the ambient the entire time the hot liquid is being consumed. This exposure to the ambient causes the hot liquid to rapidly cool. It would be desirable to design some form of a beverage container where the beverage container was constructed to dispense into a consuming reservior a small quantity of the hot liquid to be then consumed with the remaining portion of the hot liquid being contained within a thermally insulated vessel so that the majority of the hot liquid will remain heated during the entire time that the hot liquid is being consumed.

SUMMARY OF THE INVENTION

The primary objective of the present invention is to construct an individual single serving size, hot liquid beverage container where the hot liquid can be maintained at an elevated temperature for a substantial period of time with this beverage container permitting sequential dispensing into a consuming reservior of a series of small quantities of the hot liquid to then be consumed.

Another objective of the present invention is to construct a beverage container wherein the hot liquid is retained in a non-spillable condition as long as there is no hot liquid supplied to the consuming reservoir of the beverage container.

The beverage container of the present invention comprises a vessel which has an enclosing chamber within which is to be contained the desired quantity of hot liquid, typically six to twelve ounces in volume. This vessel is to be then closed with a cap forming an air chamber between the cap and the hot liquid. Pressurized air is to be supplied into the air chamber which causes the hot liquid to be forced through a dispensing tube. Mounted in conjunction with the dispensing tube is a valve. The valve can be either automatically operated due to the pressure of the liquid or can be manually operated. The valve is mounted within the cap with the cap also including a consuming reservoir. When the valve is open, a small quantity of the hot liquid is conductible through the tube dispensing into the consuming reservoir, and once the desired small quantity of liquid that is to be consumed is located within the consuming reservoir, the dispensing valve may automatically close or be closed manually preventing further dispensing of the hot liquid into the consuming reservoir. The liquid in the consuming reservoir is then to be consumed. Once the liquid is consumed from the consuming reservoir, the dispensing of another quality of the hot liquid into the consuming reservoir can then be initiated. Pumping of the pressurized air into the air chamber is to be accomplished manually by the consumer by either using a bellows or a hand operated piston cylinder air pump.

DETAILED DESCRIPTION OF THE PREFERRED EMBODIMENTS

Figure 1:
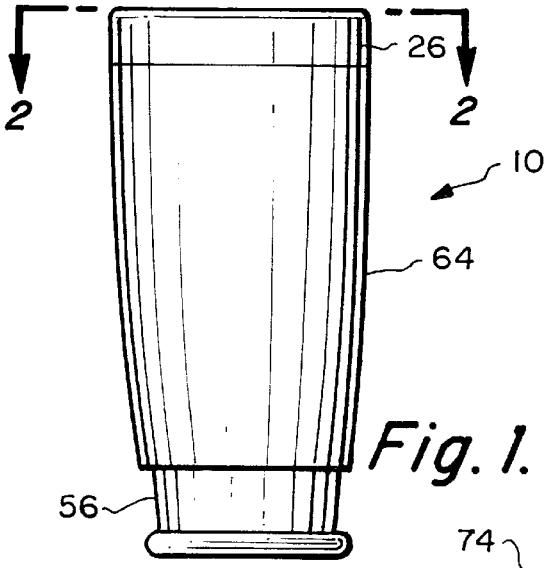
FIG. 1 is a side elevational view of the first embodiment of beverage container of this invention.
Figure 2:
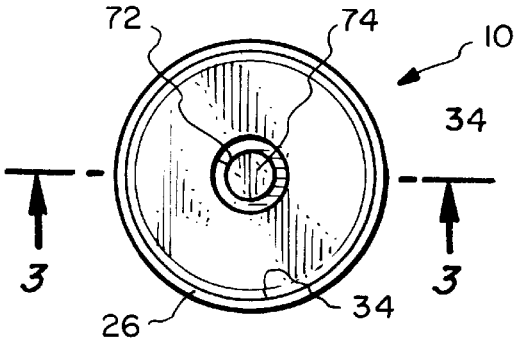
FIG. 2 is a top plan view of the first embodiment of beverage container of this invention taken along line 2—2 of FIG. 1.

Referring particularly to the drawings, there is shown in FIGS. 1–4 the first embodiment 10 of beverage container of this invention. The first embodiment 10 has a vessel 12 which has an internal chamber 14. The internal chamber 14 is open at the top edge 16 and closed at the bottom 18. A typical material of construction of the vessel 12 would normally be a rigid sheet plastic material. The top edge 16 is integrally connected to an annular, enlarged flange 20. The flange 20 includes a series of internal screw threads 22. The bottom 18 has an external protrusion 24. The function of the protrusion 24 will be explained further on in the specification.

A cap 26 has an annular, narrowed flange 28 which includes a series of external screw threads 30. The cap 26 is basically in the form of a sleeve that includes a transverse wall 32. Above the transverse wall 32 is located a reservoir 34 with this reservoir 34 being open to the ambient. Threads 30 are to connect with the threads 22 which will result in the cap 26 being secured to the vessel 12 with the transverse wall 32 closing the internal chamber 14 to the ambient forming an internal air chamber 36. Formed within the wall of the vessel 12 is a valve chamber 38. Located within the valve chamber 38 is a ball 40 which abuts against a coil spring 42. The outer end of the coil spring 42 abuts against a washer 44. The ball 40, under action of the bias of the coil spring 42, is to be locatable against a valve seat 46 to close off passage 48 thereby preventing flow of air or liquid through an air supply tube 50 toward a bellows 54. Passage 48 connects with air supply tube 50 which connects with air outlet 52 of the bellows 54. Normally the bellows 54 would be connected of a rubber or plastic material. Bellows 54 is mounted within a base 56. The upper wall of the bellows 54 includes a hole 58. The protrusion 24 is to connect with the hole 58.

Figure 3:
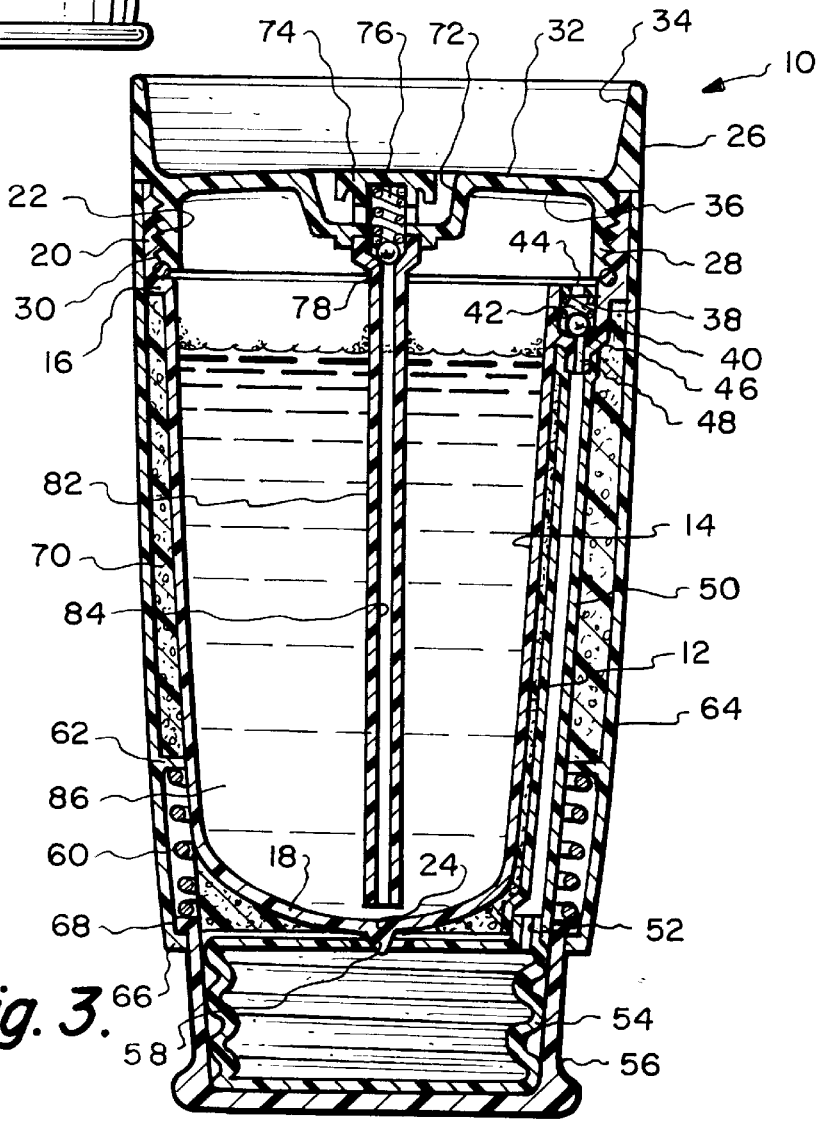
FIG. 3 is a cross-sectional view of the first embodiment of beverage container of this invention taken along line 3—3 of FIG. 2 with no portion of the hot liquid located within consuming reservoir of the beverage container.
Figure 4:
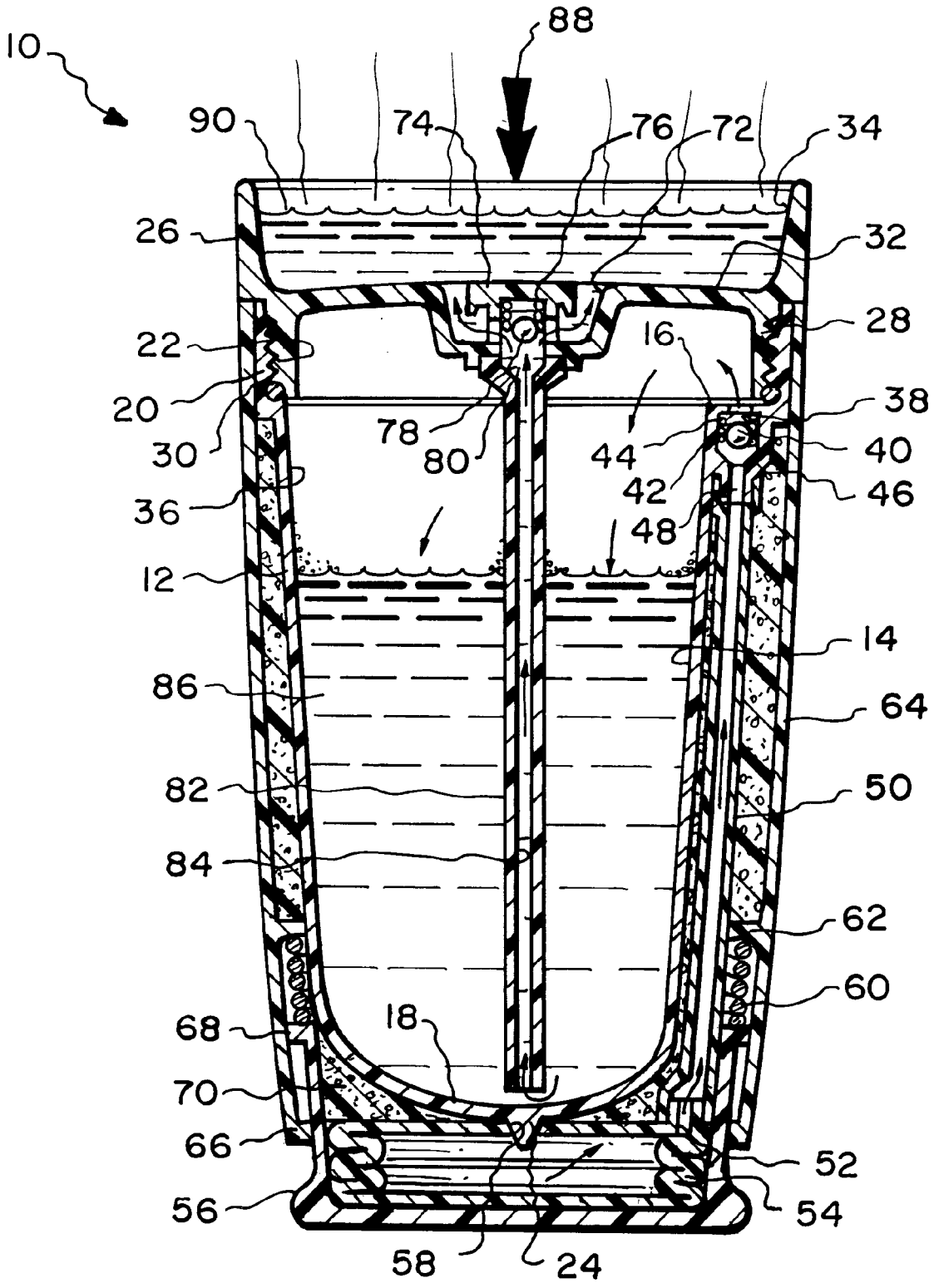
FIG. 4 is a cross-sectional view similar to FIG. 3 but showing a quantity of hot liquid contained within the consuming reservoir to then be consumed by the user.
Figure 5:
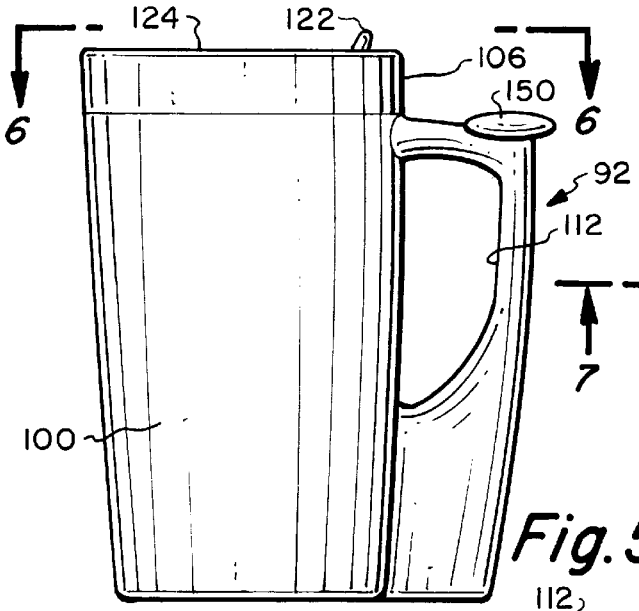
FIG. 5 is a side elevational view of a second embodiment of beverage container of this invention.
Figure 6:
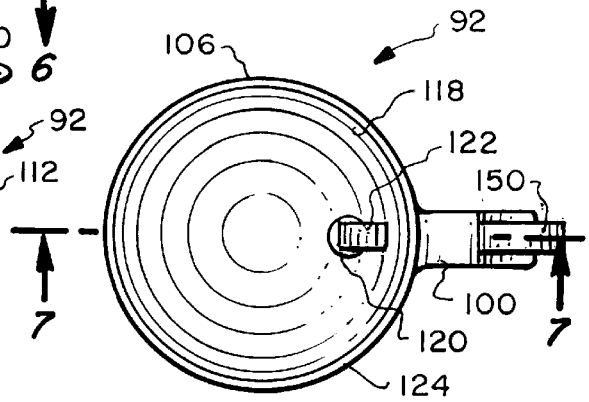
FIG. 6 is a top plan view of the second embodiment of beverage container of this invention taken along line 6—6 of FIG. 5.

Abutting against the base 56 and surrounding the lower portion of the vessel 12 is a coil spring 60. The upper end of the coil spring 60 abuts against a ring 62. The ring 62 is integrally formed on the inside surface of a sleeve 64. Sleeve 64 is located about the vessel 12 with the upper edge of the sleeve 64 connecting with the cap 26. The lower end of the sleeve 64 includes an inwardly extending flange 66. The sidewall of the base 66 has an open upper end which includes an outwardly extending annular bead 68. The function of the annular bead 68 is to abut against the inwardly extending flange 66 which defines the at-rest position of the first embodiment 10 of this invention as shown in FIG. 3 of the drawings. In this at-rest position, air is permitted to pass through the hole 58 and is to fill the interior of the bellows 54. In the voids between the sleeve 64, the vessel 12 and the bellows 54 there is located a thermal insulation material 70 which generally will be in the nature of a foam.

The transverse wall 32 includes a recess 72. Mounted within the recess 72 is a valve cover 74. The valve cover 74 is integral with the transverse wall 32. Mounted within the valve cover 74 is a coil spring 76. The lower end of the coil spring is connected to a ball 78. The ball 78 is positioned in an at-rest position against a seat 80. The seat 80 is formed within a discharge tube 82 which includes a discharge passage 84. The ball 78, in the at-rest position, closes the discharge passage 84.

The operation of the first embodiment 10 of this invention is as follows: The cap 28 is to be disengaged from the vessel 12 by unthreading of the threads 30 from the threads 22. This will expose the internal chamber 14 to permit a hot liquid 86 to be poured within the internal chamber 14 substantially filling such. The user then resecures the cap 26 to the vessel 12 forming of the air chamber 36 above the level of the liquid 86. At this time, the first embodiment 10 will contain and maintain the liquid 86 at its established elevated temperature minimizing heat loss from the liquid 86. Also, spilling of the liquid 86 is prevented.

Let it be assumed that the user now wishes to consume some of the liquid 86. The user grasps the sleeve 64 and exerts a downward pressure in the direction of arrow 88 working against coil spring 60. This will cause the cap 26, the vessel 12 and the sleeve 64 to all move relative to the base 56 with the inwardly extending flange 66 moving away from the outwardly extending annular bead 68. The protrusion 24 will then close off the hole 56, and as the bottom 18 of the vessel 12 presses against the bellows 54, the bellows 54 is collapsed. Air from within the bellows 54 is moved through the air outlet 52 to within the air supply tube 50, from the air supply tube 50 to unseat of ball 40 and discharge the air within the air chamber 36. This causes an increased air pressure to occur within the air chamber 36. The user then releases the sleeve 64 which is automatically moved to the retracted position (FIG. 3) by the bias of coil spring 60. It is to be understood that the user can manually repeat this procedure moving repeatably the vessel 12 relative to the bellows 54 in order to obtain a desired level of air pressure within the air chamber 36.

The air pressure within the air chamber 36 causes some of the hot liquid 86 to flow within the discharge passage 84 past the ball 78 into the recess 72 and then into the reservoir 34. The amount of the liquid contained within the reservoir 34 is deemed the consumable liquid 90. The user is then to function to consume the liquid 90, and during this consumption, the liquid 86 is maintained at its established elevated temperature since it is not in contact with the ambient air as is the consumable liquid 90. When the liquid 90 is consumed, the procedure is repeated to collapse the bellows 54 and cause more of the liquid 86 to be moved within the reservoir 34.

Referring particularly to FIGS. 5–8 of the drawings, there is shown the second embodiment 92 of beverage container of this invention. The second embodiment 92 includes a vessel 94 which again is to be formed of sheet plastic material. The vessel 94 includes an internal chamber 96. Surrounding the exterior surface of the vessel 94 is a thermal insulation material 98, such as a plastic foam. The vessel 94 and the insulation material 98 are encased within an exterior shell 100.

The upper end of the vessel 94 has an annular enlarged flange 102 which has a series of internal screw threads 104. A cap 106 has an annular narrow flange 108. The annular narrow flange 108 includes a series of exterior screw threads 110. During use of the second embodiment 92 of this invention, exterior screw threads 110 are to threadingly engage with the threads 104 which will result in closing of the internal chamber 96 to the ambient and form an air chamber 112 above the quantity of hot liquid 114 that is located within the internal chamber 96. Closing of the internal chamber 96 by the cap 106 is accomplished by the transverse wall 116. Located above the transverse wall 116 is a reservoir 118.

A transverse wall 116 includes a hole 120. Mounted within the hole 120 is a valve stem 122 with this valve stem 122 having a portion that extends outwardly above the upper edge 124 of the reservoir 118. The valve stem 122 includes an enlarged annular section 126 which is to normally, at rest, press tightly against seat 128 preventing flow of the liquid through the hole 120 into the reservoir 118. The seating is normally accomplished by means of a coil spring 130 which exerts a continuous bias tending to locate the enlarged annular section 126 against the seat 128. The outer end of the coil spring 130 presses against the inner surface of a mounting box 132 within which is located a passage 134. The passage 134 connects with passage 136 formed within discharge tube 138. The discharge tube 138 is located within the internal chamber 96 with the lower end of the discharge tube 138 being located directly adjacent the bottom 140 of the vessel 94.

Mounted within the exterior shell 100 is a cylinder 142. Cylinder 142 has an inner chamber 144. Movably mounted within the inner chamber 144 is a piston 146. The piston 146 is connected to an arm 148 with the outer end of the arm 148 being attached to a handle 150. The handle 150 is mounted exteriorly of the exterior shell 100. The movement of the piston 146 from the position shown in FIG. 7 to the position shown in FIG. 8 will result in air being sucked from the ambient through hole 151, through gap area 153, and then through orifice 152, past ball 154, through passage 156 into the inner chamber 144. The ball 154 is continuously biased by coil spring 158 toward the closed position shown in FIG. 7 which does not permit air to be conducted through the passage 156. However, the motion of the piston 146 from the position shown in FIG. 7 to the position shown in FIG. 8 causes the ball 154 to be unseated and the coil spring 158 to be compressed permitting air to be conducted through the passage 156.

Figure 7:
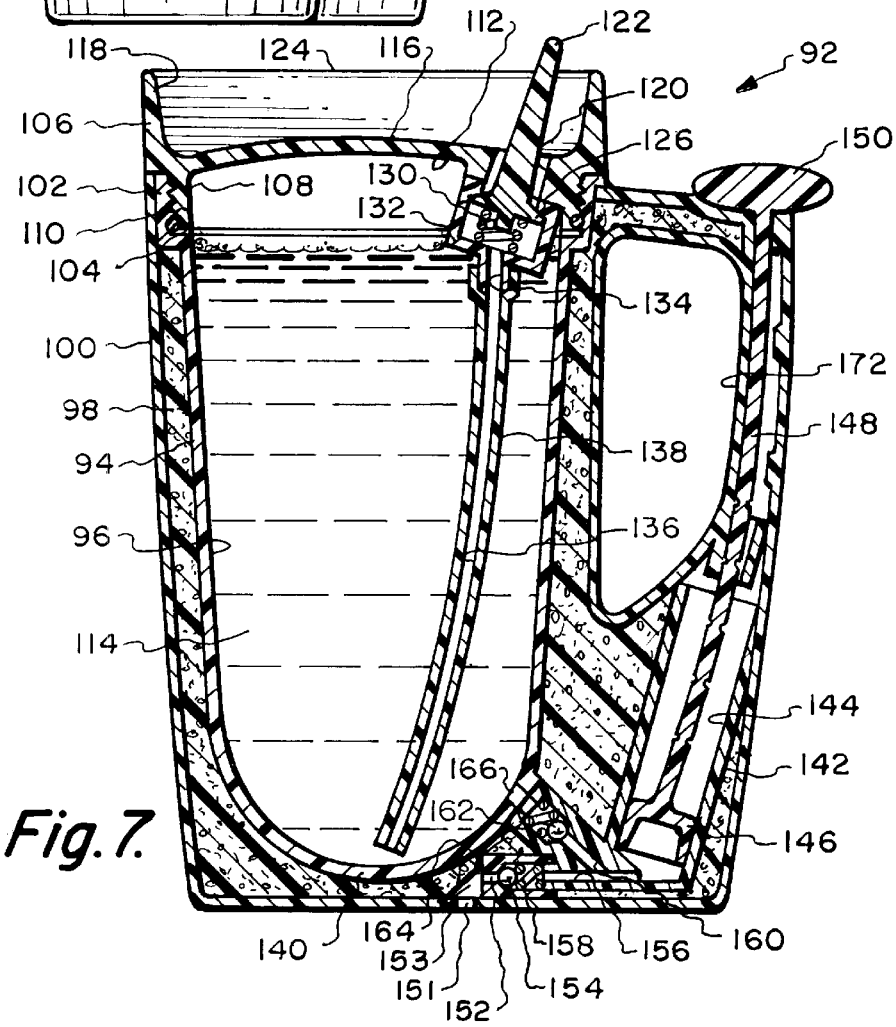
FIG. 7 is a cross-sectional view taken along line 7—7 of FIG. 6 of the second embodiment of beverage container of this invention showing no consumable liquid contained within the consuming reservoir of the beverage container.
Figure 8:
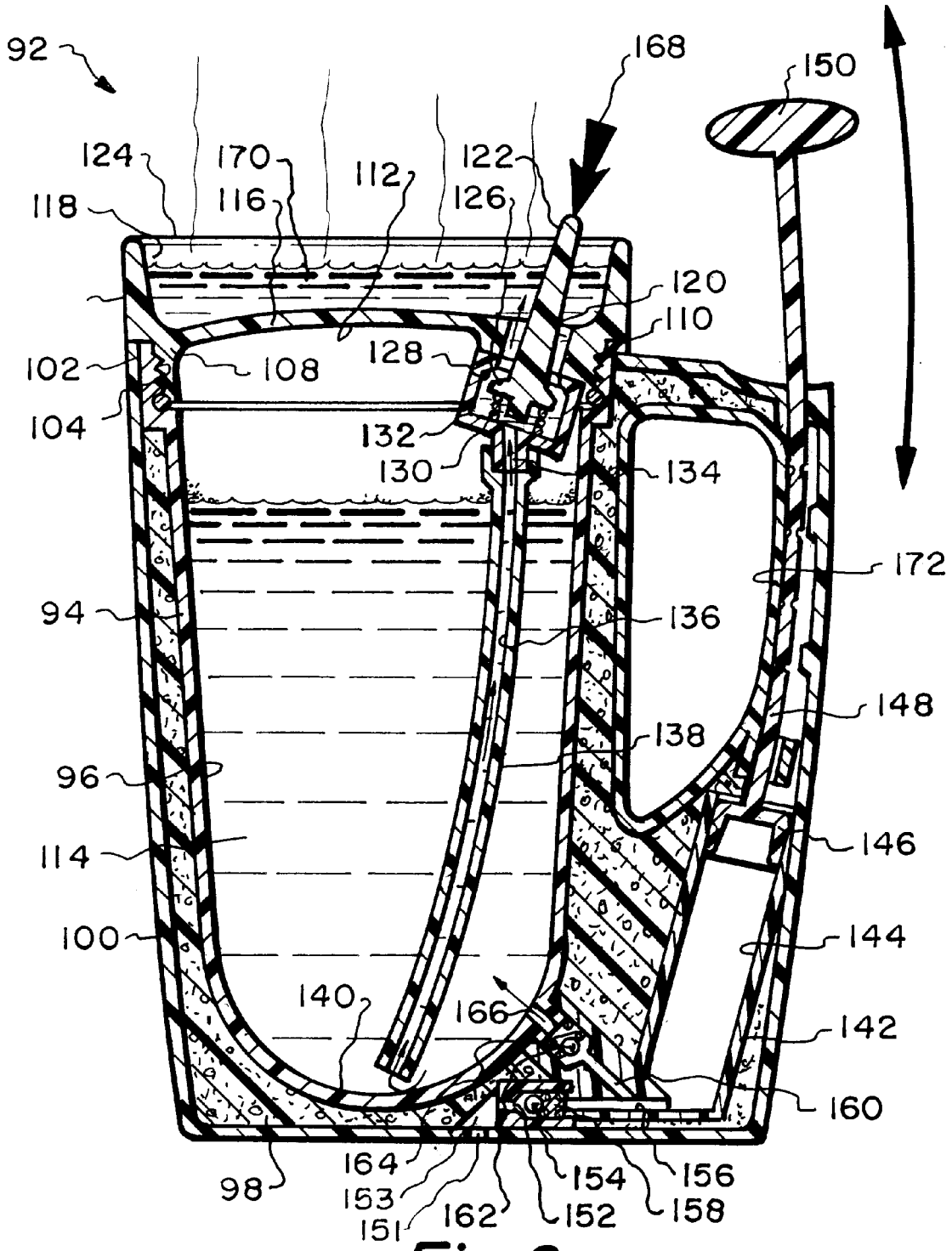
FIG. 8 is a cross-sectional view similar to FIG. 7 but showing a quantity of liquid contained within the consuming reservoir of the beverage container to then be consumed by the human user.

Movement of the piston 146 from the position shown in FIG. 8 to the position shown in FIG. 7 will result in air contained within the inner chamber 144 to be passed through passage 160 unseating ball 162, compressing coil spring 164 flowing through hole 166 into the internal chamber 96. It is to be noted that the hot liquid 114 will fill hole 166 and the chamber within which is mounted coil spring 164 and the ball 162. This air will accumulate under pressure within the air chamber 112.

The operation of the second embodiment 92 of this invention is as follows: The cap 106 is separated from the vessel 94 by the unthreading of the threads 104 and 110. The desired quantity of hot liquid 114 is then poured into the internal chamber 96 to the desired level. The cap 106 is then rethreadingly connected in a tight manner with the vessel 94. When the user wishes to consume some of the hot liquid 114, the user grasps handle 115 and exerts one or more up-and-down strokes moving of the piston 146 within the inner chamber 144. Air will then be supplied within the internal chamber 96 and become pressurized within the air chamber 112. This pressurized air will then result in some of the hot liquid being forced through the passage 136 of the discharge tube 138, through passage 134 to within the mounting box 132. One of the differences of the second embodiment 92 versus the first embodiment 10 is that the liquid 114 is not automatically discharged into the reservoir 118 which occurs within the first embodiment 10. Within the second embodiment 92, it is required that the user apply a downward pressure in the direction of arrow 168 on the valve stem 122 unseating such with respect to the seat 128. This will provide an outlet for the liquid 114 to flow through the hole 120 into the reservoir 118. The consumable liquid 170, contained within the reservoir 118, can then be consumed by the user, and when the liquid 170 has been consumed, it is only necessary for the user to unseat valve stem 122 which will cause more liquid 114 to flow into reservoir 118. If inadequate air pressure is not available to cause more liquid 114 to flow into reservoir 118, it is then necessary for the user to reapply a pumping action with the handle 150 to cause additional pressure to be supplied within internal chamber 96, and upon movement of the valve stem 122 again in the direction of arrow 168, will cause liquid 114 to flow into the reservoir 118 to be then also consumed.

The shell 100 is also to include a handle opening 172 which facilitates manual grasping and holding of the second embodiment 92 of this invention.

What is claimed is:

1. A beverage container comprising:

a vessel having a closed bottom and an open top, said vessel forming an internal chamber which is adapted to contain a liquid;

a cap removably mounted on said vessel, said cap closing said open top, said cap having a reservoir, said reservoir being open to ambient;

a liquid dispensing tube mounted within said internal chamber, said liquid dispensing tube having a lower end and an upper end, said lower end being open to said internal chamber and is positioned directly adjacent to said closed bottom of said vessel, said upper end being mounted to said cap, said upper end connecting with said reservoir;

pump means mounted in conjunction with said vessel, activation of said pump means causes pressurized air to flow into said internal chamber which forces the liquid to flow through said tube into said reservoir; and said pump means including a bellows, said bellows to be operated by movement of said vessel into contact with said bellows, said bellows to supply pressurized air into said internal chamber of said vessel.

2. The beverage container as defined in claim 1 wherein:

said bellows being mounted within a base, spring means being mounted between said base and said vessel, said spring means exerting a continuous bias tending to locate said bellows in a deactivated position, movement of said vessel against said bellows causes compressing of said spring means.

3. The beverage container comprising:

a vessel having a closed bottom and an open top, said vessel forming an internal chamber which is adapted to contain a liquid;

a cap removably mounted on said vessel, said cap closing said top, said cap having a reservoir, said reservoir being open to ambient;

a liquid dispensing tube mounted within said internal chamber, said liquid dispensing tube having a lower end and an upper end, said lower end being open to said internal chamber and is positioned directly adjacent to said closed bottom of said vessel, said upper end being mounted to said cap, said upper end connecting with said reservoir;

pump means mounted in conjunction with said vessel, activation of said pump means causes pressurized air to flow into said internal chamber which forces the liquid to flow through said tube into said reservoir; and an air inlet passage connecting with said internal chamber, a normally closed air inlet valve being mounted with said air inlet passage, said air inlet valve permitting pressurized air to be supplied into said internal chamber but preventing reverse flow of the pressurized air from said internal chamber.

4. The beverage container comprising:

a vessel having a closed bottom and an open top, said vessel forming an internal chamber which is adapted to contain a liquid;

a cap removably mounted on said vessel, said cap closing said top, said cap having a reservoir, said reservoir being open to ambient;

a liquid dispensing passage connecting with said vessel, said liquid dispensing passage having a lower end and an upper end, said lower end being located directly adjacent said bottom and being open to said internal chamber, said upper end connecting with said cap and said reservoir;

a normally closed valve assembly mounted in said cap, said normally closed valve assembly connecting with said liquid dispensing passage, said normally closed valve assembly having a valve stem which extends exteriorly of said reservoir, said valve assembly to be opened only by manual deflection of said valve stem; and pump means mounted in conjunction with said vessel, activation of said pump means causes pressurized air to flow into said internal chamber which forces the liquid to flow through said liquid dispensing passage into said reservoir if said normally closed valve is open.

5. The beverage container comprising:

a vessel having a closed bottom and an open top, said vessel forming an internal camber which is adapted to contain a liquid;

a cap removably mounted on said vessel, said cap closing said top, said cap having a reservoir, said reservoir being open to ambient;

a liquid dispensing passage connecting with said vessel, said liquid dispensing passage having a lower end and an upper end, said lower end being located directly adjacent said bottom and being open to said internal chamber, said upper end connecting with said cap and said reservoir;

pump means mounted in conjunction with said vessel, activation of said pump means causes pressurized air to flow into said internal chamber which forces the liquid to flow through said liquid dispensing passage into said reservoir; and said pump means includes a bellows, said bellows to be operative by movement of said vessel into contact with said bellows, said bellows to supply pressurized air into said internal chamber of said vessel.

6. The beverage container as defined in claim 5 wherein:

said bellows being mounted with a base, spring means being mounted between said base and said vessel, said spring means exerting a continuous bias tending to located said bellows in a deactivated position, movement of said vessel against said bellows causes compressing of said spring means.

7. The beverage container comprising:

a vessel having a closed bottom and an open top, said vessel forming an internal chamber which is adapted to contain a liquid;

a cap removably mounted on said vessel, said cap closing said top, said cap having a reservoir, said reservoir being open to ambient;

a liquid dispensing passage connecting with said vessel, said liquid dispensing passage having a lower end and an upper end, said lower end being located directly adjacent said bottom and being open to said internal chamber, said upper end connecting with said cap and said reservoir; and an air inlet passage connecting with said internal chamber, an air inlet valve mounted within said air inlet passage that is normally closed, said air inlet valve permitting pressurized air to be supplied into said internal chamber but preventing reverse flow of the pressurized air from said internal chamber.

* * * * *